US007610772B2

(12) United States Patent
Braun et al.

(10) Patent No.: US 7,610,772 B2
(45) Date of Patent: Nov. 3, 2009

(54) ICE LEVEL SENSING SYSTEM FOR A BOTTOM FREEZER REFRIGERATOR

(75) Inventors: Patrick A. Braun, Newburgh, IN (US); James Foster Dasher, Evansville, IN (US); Terry Eugene Goldman, Evansville, IN (US); Dennis Jan Staley, Princeton, IN (US); John Charles Meadway, Newburgh, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 579 days.

(21) Appl. No.: 11/369,083

(22) Filed: Mar. 6, 2006

(65) Prior Publication Data

US 2007/0204644 A1 Sep. 6, 2007

(51) Int. Cl.
*F25C 5/18* (2006.01)

(52) U.S. Cl. ..... 62/344; 62/298; 62/137; 62/66

(58) Field of Classification Search ..... 367/908; 62/340, 379, 529, 137, 74, 347, 303, 344; 257/81; 165/78
See application file for complete search history.

(56) References Cited

U.S. PATENT DOCUMENTS 3,545,217 A 12/1970 Linstromberg
5,980,009 A * 11/1999 Atalla et al. ..... 312/408
6,050,097 A 4/2000 Nelson et al. ..... 62/137
6,286,324 B1 9/2001 Pastryk et al. ..... 62/137
6,314,745 B1 * 11/2001 Janke et al. ..... 62/137
6,351,958 B1 3/2002 Pastryk et al. ..... 62/137
6,438,976 B2 8/2002 Shapiro et al. ..... 62/135
6,442,954 B1 9/2002 Shapiro et al. ..... 62/137
2007/0018548 A1 * 1/2007 Ertz et al. ..... 312/402

* cited by examiner

*Primary Examiner*—Greg Vidovich
*Assistant Examiner*—Justin Loffredo
(74) *Attorney, Agent, or Firm*—Kirk W. Goodwin; Greer, Burns & Crain Ltd

(57) ABSTRACT

A refrigeration appliance is provided with a freezer compartment accessible through an openable door, the freezer compartment extending between two side walls. An ice bin is slidably mounted in the freezer compartment occupying a width of the freezer compartment, less than a full width between the two side walls. A food storage compartment is slidably mounted in the freezer compartment with at least a portion horizontally adjacent to the ice bin, and slidable independently of the ice bin. A non-contact ice level sensing apparatus having an emitter component and a receiver component is provided, with one of the components mounted between the ice bin and the food storage compartment and the other of the components mounted on an opposite side of the ice bin from the food storage compartment.

20 Claims, 5 Drawing Sheets

ICE LEVEL SENSING SYSTEM FOR A BOTTOM FREEZER REFRIGERATOR

BACKGROUND OF THE INVENTION

The present invention relates generally to refrigeration devices with ice makers and ice storage bins.

Refrigeration appliances with having ice making mechanisms, and bins for storing ice made by the ice making mechanisms are well known, such as disclosed in U.S. Pat. Nos. 3,545,217, 6,050,097, 6,286,324, 6,351,958, 6,438,976 and 6,442,954.

In several of these patents, the ice bin is located in the door of a freezer compartment, and in some patents, a light beam sensor system is used to determine when the ice bin is full. The emitter and receiver components are mounted on opposite side walls of the freezer compartment, and when the door is closed, the light beam passes through an open portion of the bin, located near a top of the bin.

In other refrigeration appliance constructions, particularly where the freezer compartment is located in a lower compartment, sometimes referred to as a bottom mount freezer, the ice bins have typically been installed in movable baskets or other storage compartments, such that the ice bin takes up only a portion of the width of the freezer compartment. In these constructions, the movable basket is pulled out of the front of the compartment when the user desires access to either the ice bin or items stored in the movable basket. Since it is desired to shut off ice production when the ice bucket is full, a mechanical bail arm has typically been used to physically sense the ice level and shut off the ice maker when the ice bin is full.

This method of sensing the ice level has the potential for the bail arm to rake the cubes rearward off the top of the ice bin due to the physical contact of the bail arm and the ice in the bin, and then into the rest of the storage area when the ice bin and storage basket are moved forward for access to the ice cubes or other food items. When this occurs, return of the basket to its normal closed position may be prevented, or unusual noises may be generated upon returning the basket to its closed position, generating service calls by the user.

Further, movement of the ice bin every time the storage basket is moved results in unnecessary movement of the ice bin and requires the user to use more force than necessary to move the storage basket, both undesirable occurrences.

It would be an improvement in the art if a refrigeration appliance were provided with an ice maker and an ice storage bin occupying less than a full width of a freezer compartment and an ice level sensor not requiring contact with the ice in the ice bin.

SUMMARY OF THE INVENTION

In an embodiment of the invention, a refrigeration appliance is provided with a freezer compartment accessible through an openable door which opens as a drawer, the freezer compartment extending between two side walls. An ice bin is slidably mounted in the freezer compartment occupying a width of the freezer compartment, less than a full width between the two side walls. A food storage compartment is slidably mounted in the freezer compartment with at least a portion horizontally adjacent to the ice bin, and slidable independently of the ice bin, as well as independently slidable relative to the opening of the compartment drawer. A non-contact ice level sensing apparatus having an emitter component and a receiver component is provided, with one of the components mounted between the ice bin and the food storage compartment and the other of the components mounted on an opposite side of the ice bin from the food storage compartment.

In an embodiment, the invention provides a refrigeration appliance including a freezer compartment having a plurality of walls and an access opening. The refrigeration appliance further includes an ice making mechanism disposed within the freezer compartment and an ice bin mounted in the freezer compartment below the ice making mechanism. A first structural member is secured in the freezer compartment and a first track is attached to the first structural member. A second structural member is secured in the freezer compartment and a second track is attached to the second structural member. The ice bin is mounted on the first and second track to slide into and out of the access opening. An emitter component is attached to the first structural member to emit a beam of light across an upper portion of the bin and a receiver component is attached to the second structural member opposite the emitter component to receive the beam of light.

The refrigeration appliance may comprise a first refrigeration compartment, being a fresh food compartment, and a second refrigeration compartment being the freezer compartment. The compartments may be separate from one another, such as by having a wall therebetween. Both compartments may be accessible through openable doors, which may be separate doors for each compartment.

The emitter component and the receiver component may be part of an ice level sensing apparatus.

In an embodiment, one of the first and second structural members is mounted to a side wall of the freezer compartment.

In an embodiment, one of the first and second structural members is mounted between side walls of the freezer compartment.

In an embodiment, the ice bin has side walls with open areas therein to allow passage of the light beam from the emitter component to the receiver component.

In an embodiment, the second structural member includes a third sliding rail to support a sliding storage compartment. In an embodiment, a fourth sliding rail is carried on a side wall of the freezer compartment to support the sliding storage compartment.

These and other aspects and details of the present invention will become apparent upon a reading of the detailed description and a review of the accompanying drawings. Specific embodiments of the present invention are described herein. The present invention is not intended to be limited to only these embodiments. Changes and modifications can be made to the described embodiments and yet fall within the scope of the present invention.

DETAILED DESCRIPTION OF THE PREFERRED EMBODIMENTS

The present invention finds particular utility in a domestic refrigerator having a fresh food compartment located above a freezer compartment, however, the invention can be used in other refrigeration appliances having different configurations. In order to provide a disclosure of the invention, the embodiment of a refrigeration appliance with a freezer compartment located below a fresh food compartment is shown and illustrated, it being understood that the scope of the invention is not limited to such an arrangement.

Figure 1:
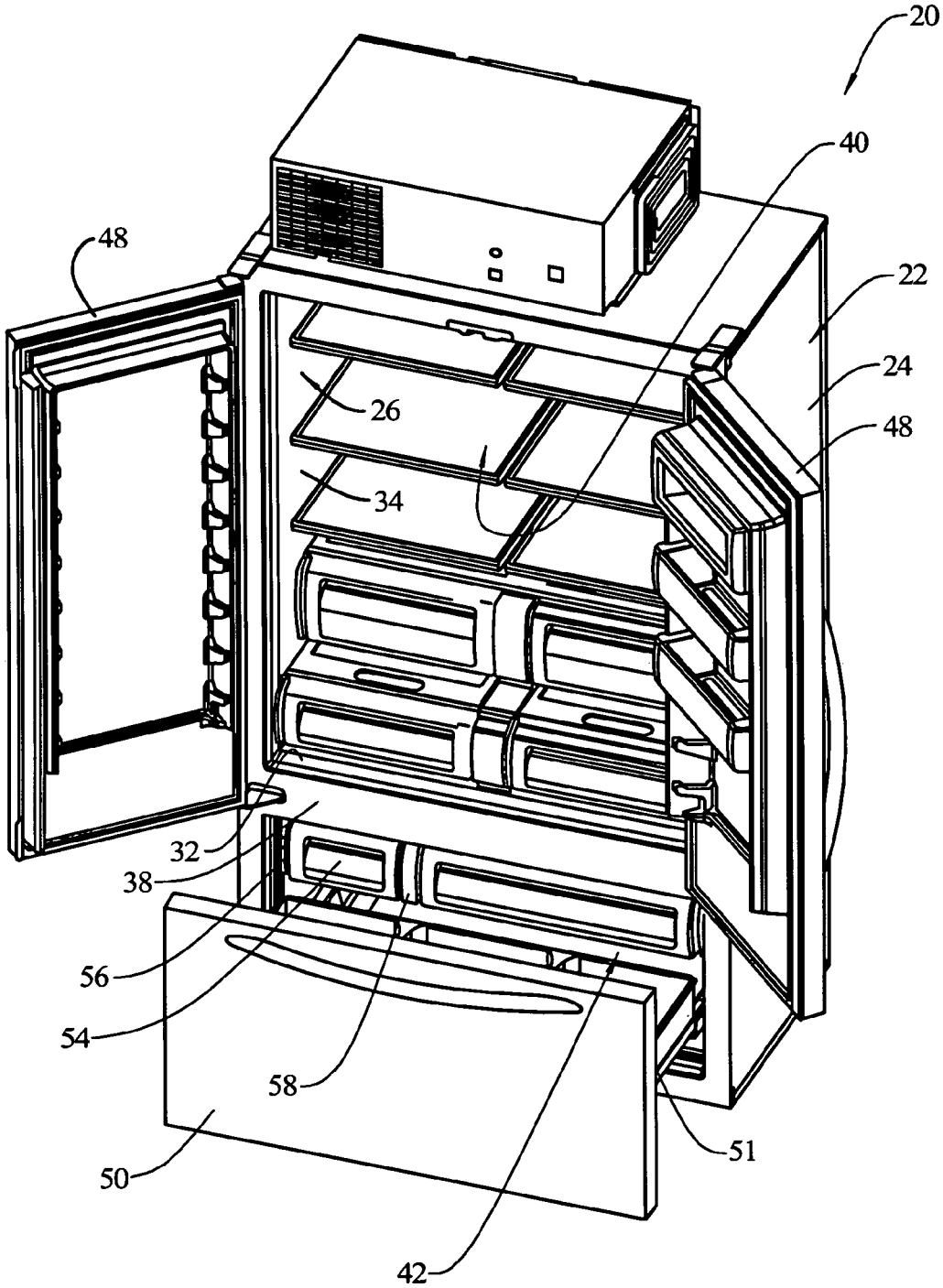
FIG. 1 is a front elevational view of a refrigeration appliance embodying the principles of the present invention.

FIG. 1 illustrates a refrigeration appliance 20, such as a refrigerator/freezer, which includes an ice level sensing system according to the present invention. The refrigeration appliance 20 includes a cabinet 22 having top, rear and side walls defining an outer shell 24. A liner 26 is spaced inwardly from the shell 24. The liner 26 includes a top wall 28, a back wall 30, a bottom wall 32, and opposite side walls 34 and 36. A partition in the form of a separator 38 may divide the cabinet 22 into a first refrigeration compartment 40 being an upper fresh food compartment and a second refrigeration compartment 42 being a lower freezer compartment, each having a front access opening. As shown, a pair of fresh food doors 48 are hingedly mounted to the cabinet 22 to provide selective access to the fresh food compartment 40. A freezer door 50 is mounted on drawer slides 51 to the cabinet 22 to provide selected access to the freezer compartment 42.

In some configurations, the fresh food compartment 40 and the freezer compartment 42 may use separate tubs or liners or a single liner. In some configurations, the two compartments may be accessible through a single door. In other alternative configurations, the refrigeration appliance 20 may contain only a freezer compartment.

Figure 2:
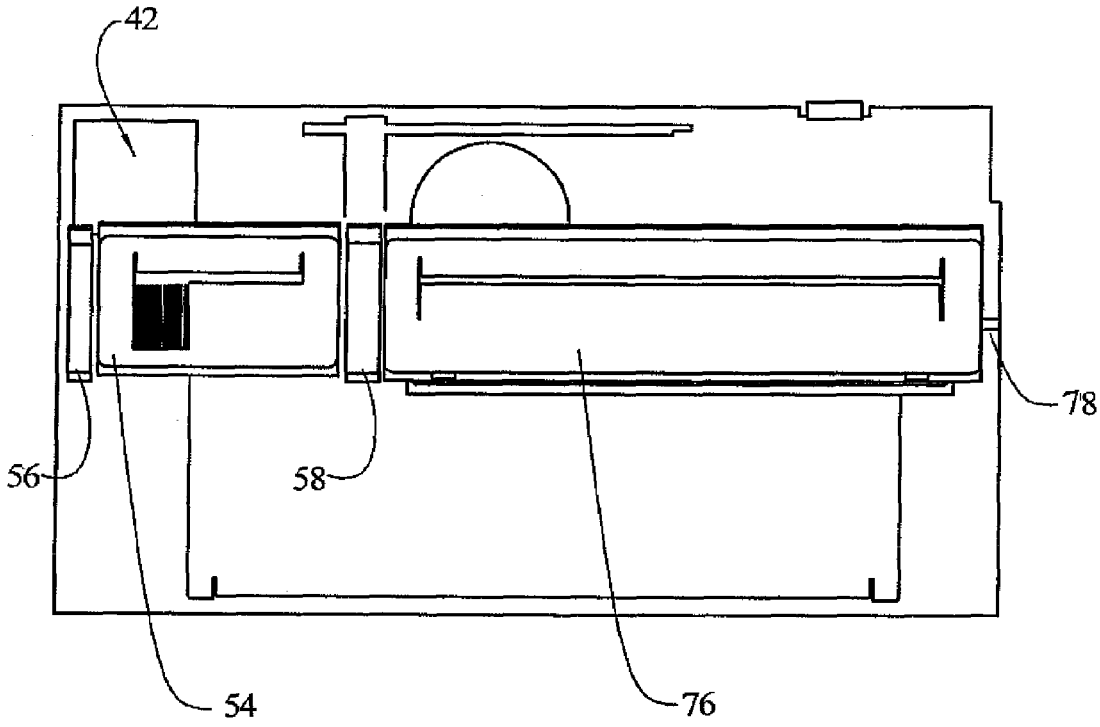
FIG. 2 is a partial front elevational view of a portion of the freezer compartment of the refrigeration appliance of FIG. 1.

The refrigeration appliance 20 further includes an ice making mechanism 52 which may be disposed within the freezer compartment 42 and an ice bin 54 mounted in the freezer compartment below the ice making mechanism. As shown in FIGS. 1 and 2, a first structural member 56 is secured in the freezer compartment 42 and a first track 57 in the form of a sliding rail (FIG. 3) is attached to the first structural member. A second structural member 58 is secured in the freezer compartment and a second track 60 in the form of a sliding rail (FIG. 4) is attached to the second structural member. The ice bin 54 is mounted on the first 57 and second 60 tracks to slide into and out of the access opening. The ice bin 54 may be provided with side flanges 59 which rest on the tracks 57, 60 so that the ice bin may slide within the freezer compartment 42, into and out of the access opening, to provide the user access to ice cubes stored in the ice bin. The ice bin 54, in an embodiment, occupies a width of the freezer compartment 42, less than a full width between the two side walls 34.

Figure 5:
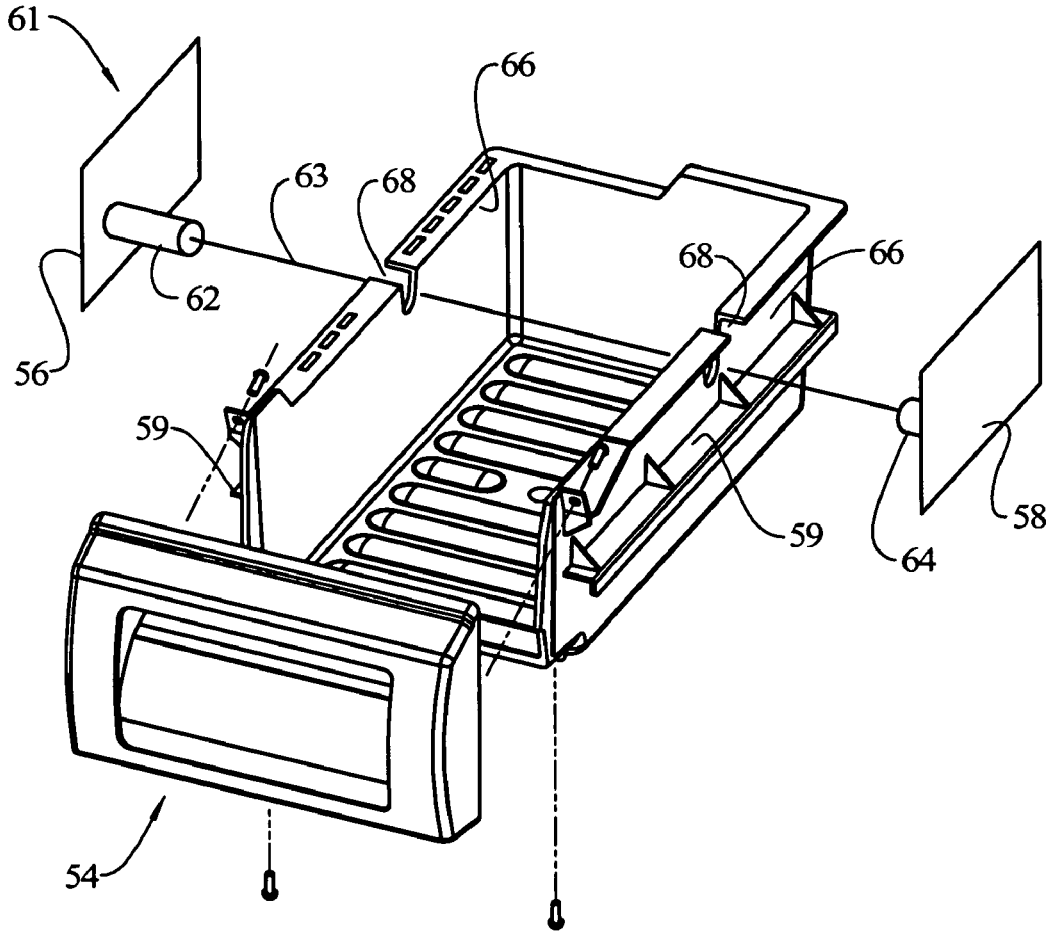
FIG. 5 is a schematic perspective view of the ice level sensing apparatus utilized in the invention.

A non-contact ice level sensing apparatus 61 has an emitter component 62 (FIGS. 3 and 5) which is attached to the first structural member 56 to emit a beam of light 63 across an upper portion of the bin 54 and a receiver component 64 which is attached to the second structural member 58 opposite the emitter component to receive the beam of light. In an embodiment as shown in FIG. 5, the ice bin 54 has side walls 66 with open areas 68 therein to allow passage of the light beam 63 from the emitter component 62 to the receiver component 64. The open areas may be in the form of slots or openings in the side walls 66. The emitted light beam 63 may be in the visible spectrum, or outside of the visible spectrum, such as infrared, but it provides a line of sight beam to be detected by the receiver component 64. The emitter component 62 and the receiver component 64 may be part of an ice level sensing apparatus as shown and described in U.S. Pat. Nos. 6,050,097, 6,286,324, 6,314,745 and 6,351,958, incorporated herein by reference.

In an embodiment, one of the first 56 and second 58 structural members is mounted to a side wall 34 of the freezer compartment 42.

In an embodiment, one of the first 56 and second 58 structural members is mounted between the side walls 34 of the freezer compartment 42, that is not abutting either wall, but rather, intermediate the two walls.

Figure 4:
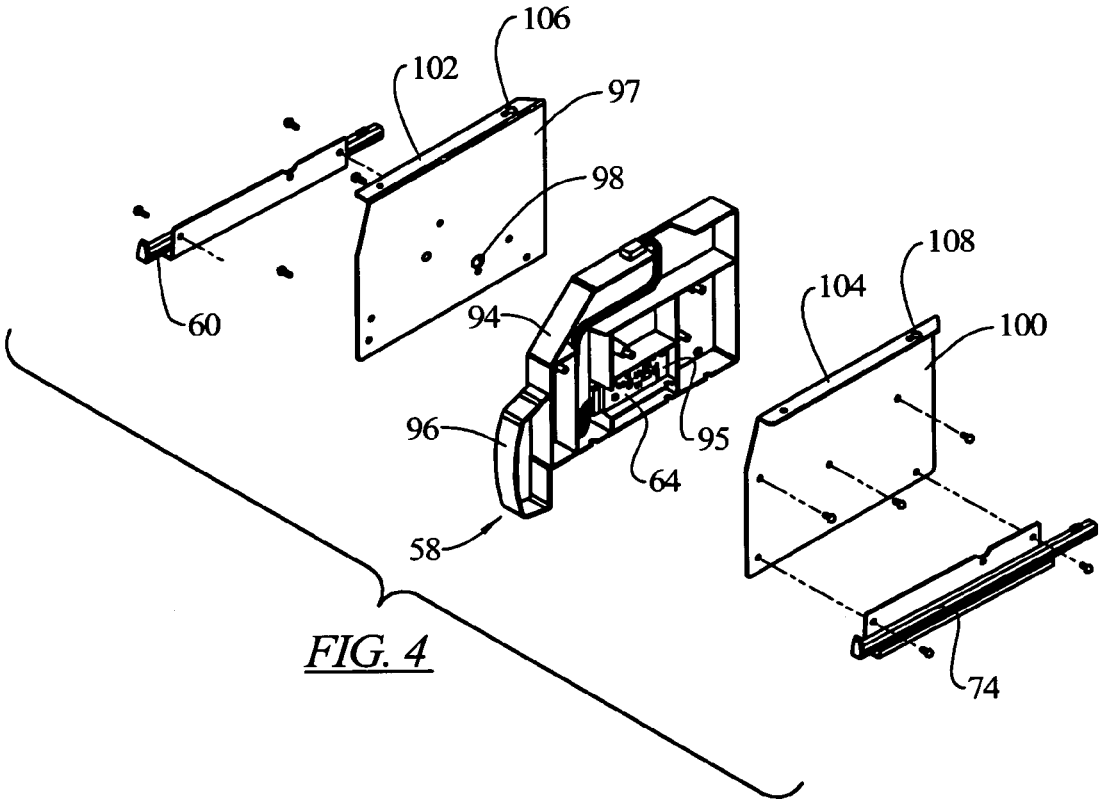
FIG. 4 is an exploded perspective view of a second structural member and various associated components.

In an embodiment, as shown in FIG. 4, the second structural member 58 includes a third track 74 in the form of a sliding rail to support a sliding storage compartment 76 (FIG. 2). In an embodiment, a fourth track 78 in the form of a sliding rail is carried on a side wall of the freezer compartment 42 to support the sliding storage compartment 76. The storage compartment 76, which may be used to store frozen food, is slidably mounted in the freezer compartment 42 with at least a portion horizontally adjacent to the ice bin 54, and it is slidable independently of the ice bin and independently of the freezer door 50.

As illustrated, the second structural member 58 carrying the receiver component 64 is mounted between the ice bin 54 and the food storage compartment 76, and the emitter component 62 is mounted on an opposite side of the ice bin from the food storage compartment, although the positions could be reversed.

Figure 3:
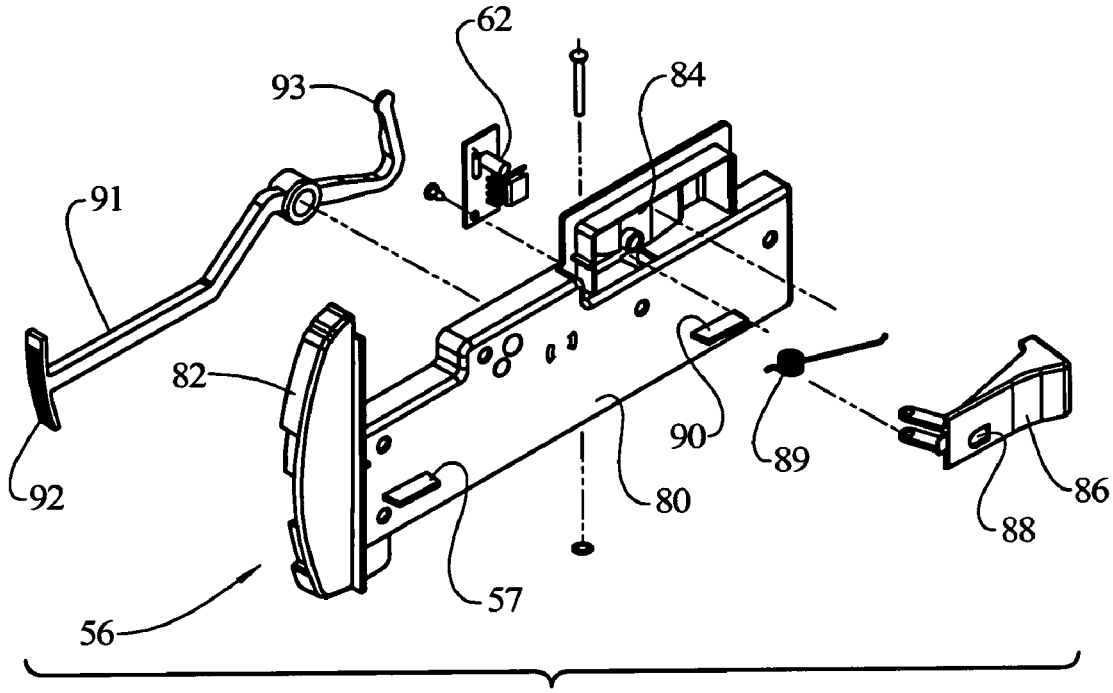
FIG. 3 is an exploded perspective view of a first structural member and various associated components.

As shown in FIG. 3, the first structural member 56 is comprised of a body portion 80 which may be secured to a wall 34, 36 of the freezer compartment 42, such as with threaded fasteners. A front end 82 of the first structural member 56 is shaped to provide an aesthetically pleasing contour complementary to a front contour of the ice bin 54 and the food storage compartment 76. The body portion 80 also carries a housing 84 which receives the emitter component 62 (although it could alternatively be the receiver component 64). A cover 86 with an opening 88 therein protects the emitter component 62, yet allows the beam of light 63 to be directed across the ice bin 54. The cover 86 may be pivotably mounted on the body portion 80 and biased with a spring 89 so that the opening 88 is aligned with the emitter component 62 to allow the beam of light 63 to pass through the opening when the ice bin 54 is pushed back into its ice receiving position, and is pivoted to a misaligned position when the ice bin is moved forwardly of the ice receiving position, such that the light beam will be broken by the cover to prevent the further production of ice when the ice bin is removed.

A pair of horizontal tabs 90 support the first track 57 which may be attached to the body 80 by fasteners, such as screws. The first track 57 may provide for a friction sliding of the ice bin 54 on the track, or the track may contain friction reducing elements, such as ball bearings, or other well known friction reducing elements to allow for easier sliding movement of the ice bin. A manually pivotable switch 91 may be carried on the body portion 80 such that a manually engagable end 92 may be moved up and down to selectively move a shutter portion 93 into and out of a blocking position relative to the beam of light 63 being emitted by the emitter 62. In this manner, the user may manually turn the ice maker off, even without removing the ice bin 54, by moving the switch 91 into a light beam blocking position.

As shown in FIG. 4, the second structural member 58 is comprised of a body portion 94 which has an internal compartment 95 for receiving the receiver component 64. A front end 96 of the second structural member 58 may be shaped to provide an aesthetically pleasing contour complementary to a front contour of the ice bin 54 and the food storage compartment 76. A first cover 97 with an opening 98 therein encloses the receiver component 64 on one side of the body portion 92, with the opening allowing the beam of light 63 to be received by the receiver component. A second cover 100 encloses the receiver component 64 on the other side of the body portion. The covers 97, 100 have top flanges 102, 104 which can be used to secure the second structural member 58 in the freezer compartment 42 by securing it to a structural component located above the second structural member. The top flanges 102, 104 may be provided with keyhole openings 106, 108 to allow the second structural member 58 to be attached to a pair of headed fasteners already provided in the structural component. The enlarged portion of the keyhole opening is large enough to allow the head to pass, and the smaller portion of the keyhole opening is too small to allow the head to pass. The headed fasteners can be tightened once the second structural member 58 is placed in position on the fasteners to secure the second structural member to the structural component. The second track 60 is attached to the first cover 97 and the third track 74 is attached to the second cover 100, such as by threaded fasteners. The construction of the second 60 and third 74 tracks (and the fourth track 78) may be similar to that of the first track 57 described above.

The present invention has been described utilizing particular embodiments. As will be evident to those skilled in the art, changes and modifications may be made to the disclosed embodiments and yet fall within the scope of the present invention. For example, various components could be utilized separately or independently in some embodiments without using all of the other components in the particular described embodiment. The disclosed embodiment is provided only to illustrate aspects of the present invention and not in any way to limit the scope and coverage of the invention. The scope of the invention is therefore to be limited only by the appended claims.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A refrigeration appliance comprising:

a freezer compartment accessible through an openable door, said freezer compartment extending between two side walls;

an ice bin slidably mounted in said freezer compartment occupying a width of said freezer compartment, less than a full width between said two side walls;

a food storage compartment slidably mounted in said freezer compartment with at least a portion horizontally adjacent to said ice bin, and slidable independently of said ice bin;

a non-contact ice level sensing apparatus having an emitter component and a receiver component, with one of said components mounted between said ice bin and said food storage compartment and the other of said components mounted on an opposite side of said ice bin from said food storage compartment.

2. A refrigeration appliance according to claim 1, wherein one of said components is mounted to a side wall of said freezer compartment.

3. A refrigeration appliance according to claim 1, wherein a structural member is provided between said ice bin and said food storage compartment, said structural member carrying a sliding rail to support said ice bin and a sliding rail to support said food storage compartment.

4. A refrigeration appliance according to claim 1, wherein said ice bin has side walls with open areas therein to allow passage of a light beam from said emitter component to said receiver component.

5. A refrigeration appliance according to claim 1, wherein said component mounted opposite from said food storage compartment is mounted on a structural member mounted on one of said, side walls of said freezer compartment.

6. A refrigeration appliance according to claim 5, wherein said structural member includes a sliding rail to support said ice bin.

7. A refrigeration appliance according to claim 1, wherein said component mounted opposite from said food storage compartment is mounted on a first structural member carried on a first of said side walls of said freezer compartment including a first sliding rail to support said ice bin, a second structural member is provided between said ice bin and said food storage compartment, said second structural member carrying a second sliding rail to support said ice bin and a third sliding rail to support said food storage compartment, and a fourth sliding rail is carried on a second of said side walls of said freezer compartment to support said food storage compartment.

8. A refrigeration appliance according to claim 1, including a fresh food compartment, with said freezer compartment being located below said fresh food compartment.

9. A refrigeration appliance according to claim 1, including an ice making mechanism located in said freezer compartment above said ice bin.

10. A refrigeration appliance comprising:

a fresh food compartment;

a freezer compartment separate from said fresh food compartment and defined by walls;

an ice making mechanism located in said freezer compartment;

an ice bin slidably mounted in said freezer compartment below said ice making mechanism;

a first structural member secured to a wall of the freezer compartment carrying a first sliding rail to support said ice bin;

a second structural member secured to a wall of the freezer compartment carrying a second sliding rail to support said ice bin; and an ice level sensing apparatus having an emitter component mounted on said first structural member and a receiver component mounted on said second structural member.

11. A refrigeration appliance according to claim 10, wherein one of said first and second structural members is mounted to a side wall of said freezer compartment.

12. A refrigeration appliance according to claim 10, wherein one of said first and second structural members is mounted between side walls of said freezer compartment.

13. A refrigeration appliance according to claim 10, wherein said ice bin has side walls with open areas therein to allow passage of a light beam from said emitter component to said receiver component.

14. A refrigeration appliance according to claim 10, wherein said second structural member includes a third sliding rail to support a sliding storage compartment.

15. A refrigeration appliance according to claim 14, including a fourth sliding rail carried on a side wall of said freezer compartment to support said sliding storage compartment.

16. A refrigeration appliance including a freezer compartment having a plurality of walls and an access opening, said refrigeration appliance comprising:

an ice making mechanism disposed within said freezer compartment;

an ice bin mounted in said freezer compartment below said ice making mechanism;

a first structural member secured to a wall in said freezer compartment;

a first track attached to said first structural member;

a second structural member secured to a wall in said freezer compartment;

a second track attached to said second structural member; said ice bin mounted on said first and second tracks to slide into and out of said access opening;

an emitter component attached to said first structural member to emit a beam of light across an upper portion of said bin; and a receiver component attached to said second structural member opposite said emitter component to receive said beam of light.

17. A refrigeration appliance according to claim 16, wherein one of said first and second structural members is secured to one of said walls of said freezer compartment.

18. A refrigeration appliance according to claim 16, wherein one of said first and second structural members is secured in said freezer compartment at a position intermediate said walls.

19. A refrigeration appliance according to claim 16, including a third track attached to said second structural member, and a sliding storage compartment mounted on said third track to slide into and out of said access opening independently of said bin.

20. A refrigeration appliance according to claim 19, including a fourth track attached to said second structural member to support said sliding storage compartment.

* * * * *

UNITED STATES PATENT AND TRADEMARK OFFICE

CERTIFICATE OF CORRECTION

PATENT NO. : 7,610,772 B2
APPLICATION NO. : 11/369083
DATED : November 3, 2009
INVENTOR(S) : Braun et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 821 days.

Signed and Sealed this

Twelfth Day of October, 2010

David J. Kappos

David J. Kappos
*Director of the United States Patent and Trademark Office*